United States Patent [19]

Shieh

[11] Patent Number: 4,489,941

[45] Date of Patent: Dec. 25, 1984

[54] SPORTS NET APPARATUS

[76] Inventor: Shin-Shi Shieh, 56-3, Kien Kwo N. Rd., Taipei, Taiwan

[21] Appl. No.: 420,661

[22] Filed: Sep. 21, 1982

[51] Int. Cl.[3] ..... A63B 69/00

[52] U.S. Cl. ..... 273/26 A; 273/407; 273/395; 273/29 A; 273/181 F; 272/65

[58] Field of Search ..... 273/26 A, 374, 411, 273/328, 348, 354, 29 BC, 73 D, 73 L, 176 B, 181 A, 181 D, 181 E, 181 F, 181 J, 181 K, 182 R, 402, 407, 410, 397, 398, 396, 400, 401, 389, 29 BC, 395; 272/65

[56] References Cited

U.S. PATENT DOCUMENTS

| | | | |
|---|---|---|---|
| 240,183 | 4/1881 | Richardson | 273/73 L |
| 2,915,314 | 12/1959 | Phillips | 273/26 A |
| 2,992,002 | 7/1961 | Bingham, Jr. | 273/26 A |
| 3,502,330 | 3/1970 | Cheftel | 272/65 |
| 4,072,295 | 2/1978 | Roberts | 273/26 A |
| 4,206,916 | 6/1980 | Epply | 273/26 A |
| 4,239,235 | 12/1980 | Torres | 273/395 |
| 4,254,952 | 3/1981 | Playter | 273/401 |
| 4,264,070 | 4/1981 | Torres | 273/407 |

FOREIGN PATENT DOCUMENTS

| | | | |
|---|---|---|---|
| 1954912 | 10/1969 | Fed. Rep. of Germany | 273/73 L |
| 2411752 | 10/1980 | France | 273/411 |
| 18900 | of 1901 | United Kingdom | 273/411 |
| 21781 | of 1902 | United Kingdom | 273/400 |

*Primary Examiner*—Richard C. Pinkham
*Assistant Examiner*—T. Brown
*Attorney, Agent, or Firm*—Karl W. Flocks; Sheridan Neimark

[57] ABSTRACT

A sports net and frame includes inner frame members, a substantially rectangular outer frame and a netting material. The inner frame is characterized by at least two adjusting rods, each rod being attached by spring elements in a spaced relationship to a side of the netting material and substantially perpendicular to each other. The outer frame is attached by spring elements to at least two perpendicular sides of the netting material. Adjustable screws attach each adjusting rod to the outer frame whereby adjustment of the screws results in adjusting the tension in the netting material. The outer frame is further provided with elements for attaching a sports net and frame of identical structure.

4 Claims, 5 Drawing Figures

SPORTS NET APPARATUS

SUMMARY OF THE INVENTION

The present invention provides for a movable webwork support structure for the training and sporting of ball games including a web support construction by using a formwork comprising metal members, plastic members and rubber tubes complete with a nylon or other material grill gridwork as the center structure, characterized in that, by means of a number of composite twin-hooked spring retainers, one end of the metal tubework in union with webwork is coupled to like number of composite retainer rings as provided to the metal tube wall and the wall for the adjustment rods within the framework of the support, whereas the other end being coupled to the web wall, thus forming a webwork. The corners on the periphery of the four metal tubes of the webwork being prepared with two-way tube joints to accommodate coupling with the metal tubes, two sides of the webwork disposed between the webwork and the metal tubes, complete with an adjustment rod, penetrating the metal tube by means of a number of adjustment screws and secured therein with the threads as provided therein, in order that as the adjustment screws are turned about to displace the adjustment rod to achieve adjustment of the resilience of the webwork.

The structure of the webwork as disclosed in the foregoing is available for resetting to other setting configurations by altering the footing arrangement of the connection joints and connection members concerned, for the purpose of reverberations of an impingement force received or of cancellation thereof thereby accommodating for the training and sporting services of a variety of ball games.

Regular ball game and athletic activities will usually be bound to be limited in specific fields or sites where particular facilities are readily available, for instance, a tennis court, a badminton course, a golf course, etc. This necessity to have particular facilities set in order for a given atheletic game, a ball game, in particular, will easily result in overcrowded conditions of the sports court or course or fields as the sports population is growing so fast nowadays. What is even worse is that the occupancy time for a player in any a sporting course is reduced to an extent out of proportion to the time he has spent in waiting for his turn to join in the play, and some would even eventually find that they have come too late and therefore, have come in vain.

The primary objective of the present invention, is, in view of the drawbacks of existing sports fields such as those specified above, to provide a newly and simply structured movable webwork support for the training and sporting of ball games that is suitable for use by team groups, as well as by individual players, at home or indoors or in open fields, for the practicing and enjoyment of various ball games, to save the interested players a lot of time thereby achieving the goal of convenience in sporting activities.

It is believed that a better understanding of the present invention can be had with respect to its detailed structural logic, purposes, characteristic points and other merits by a study of the following description with reference to the accompanied drawings.

DETAILED DESCRIPTION

Figure 1:
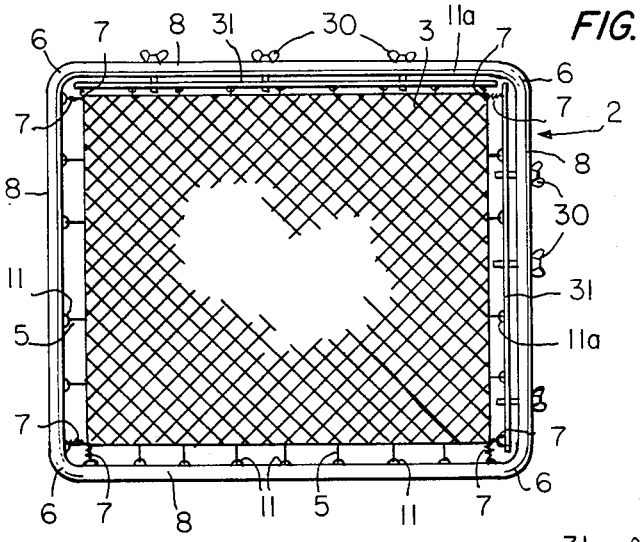
FIG. 1 is a surface view of the single-face webwork as covered by the present invention.
Figure 2:
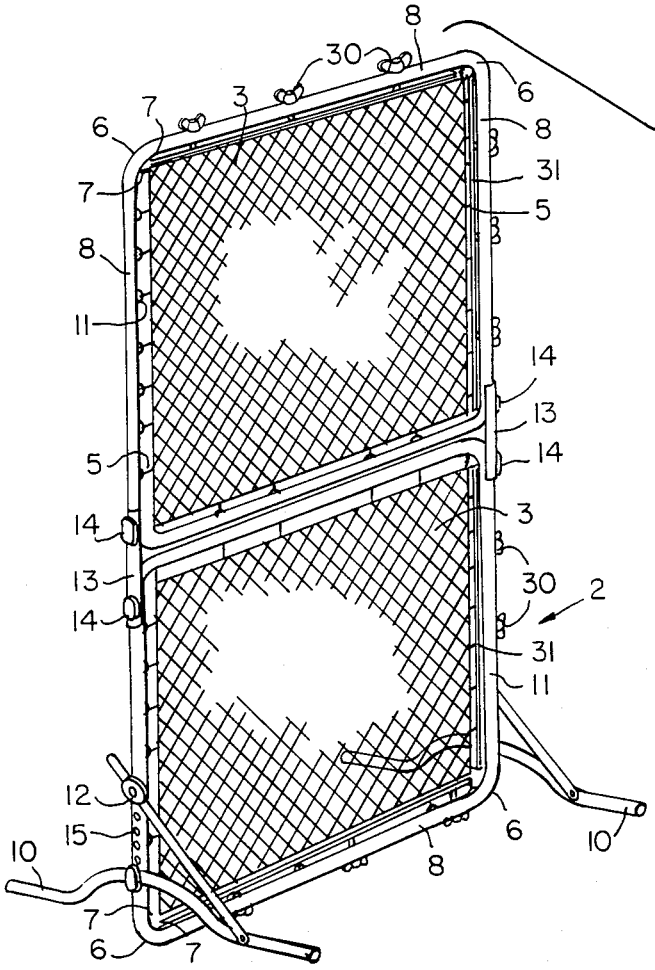
FIG. 2 is an embodiment view of two pieces of webworks stretched to erection as covered by the present invention.
Figure 2:
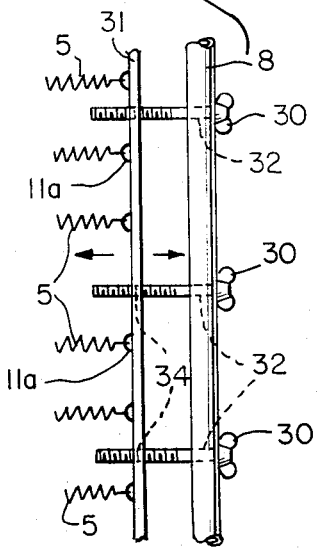

Referring to FIG. 1 and FIG. 2 it is seen that the present invention titled Movable Webwork Support for the Training and Sporting of Ball Games is made of four metal rim tubings 8 over the periphery of a single webform, complete with an elbow-like, two-way joint 6 at each corner; altogether they form a framework; on an adjoining side of the framework there are provided a two-way hook ring spring retainer 7 and another spring retainer 5, which altogether will be snap-attached to a number of composite snap rings 11 as provided on the wall of two metal tubes 8. Another adjoining side of the framework is complete with two adjustment rods 31 complete with internally threaded composite holes 34 on the inner wall of the rods. Still another side is set with a number of composite snap rings 11*a* to accommodate coupling to the corresponding edges of the spring snap retainers 5, 7 whereas the other end of the snap ring 11*a* is attached to webwork 3. Assembling works should proceed as follows; a number of composite oblong adjustment screws 30 shall first pass through the equal number of composite holes 32 as provided on the inner wall of the metal tubes 8 before being disposed into the composite holes 34 as provided on the inner wall of the adjustment rods 31. The idea is that once fitting accordingly is done, rotation of the adjustment screws 30 will serve to drive the adjustment rod 31 to displace sideways in arrow directions, as illustrated in FIG. 2, so that due effects will be brought to the spring retainers 5, 7 that are provided in the retainer rings 11*a* on the rods 31 as would be reflected in the loosening or tightening of the retainers, thereby achieving in the successful adjustment of the resilience of the webwork 3 according to given requirement for each training or play programme for which the present invention serves as the supporting structure of the goal or target of the game involved, such as the striking training of tennis game, pitching training in a baseball game, and other techniques of a golf tournament.

Referring to FIG. 2 it is seen that two webforms are altogether locked into the joint holes 15 as provided on the inner wall of the metal tubes 8 by means of joint fixture 13 and the fastening bolts 14, to be secured onto the joint holes in conjunction with two footing racks 10 by the fastening of the fastening bolts 12. The outcome is an erected webwork structure, which, produced to the same setting for two or three erections, will very well serve as the goal in a game in the training program or recreational playing of badminton contests.

Figure 3:
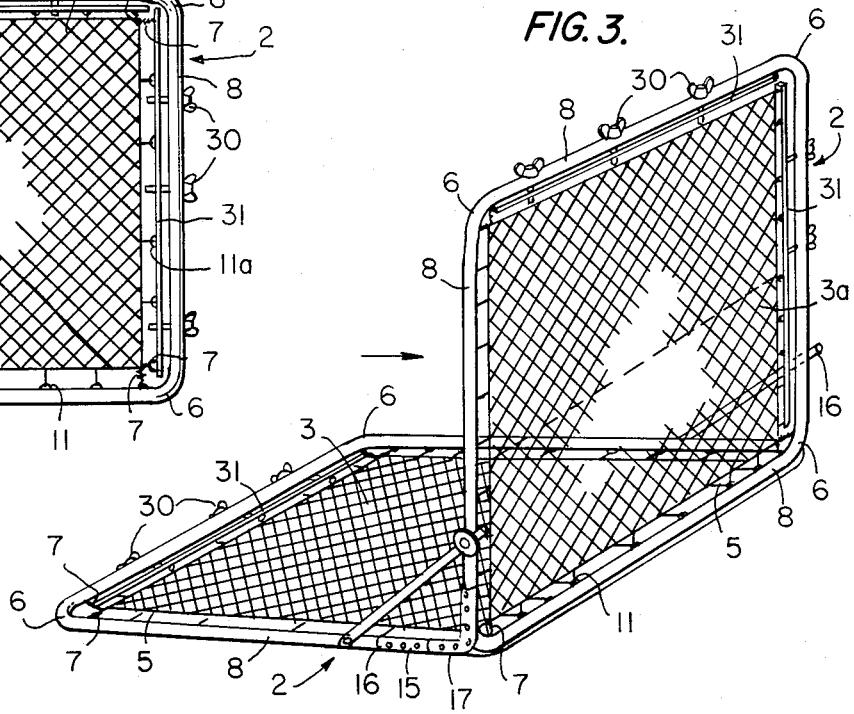
FIG. 3 is an embodiment view of two pieces of webworks stretched to an L setting as covered by the present invention.

Referring to FIG. 3 it is seen a setting in an L profile by the joint erection of two webforms 16, the bent corner is secured with an L shape fixture 17. It is interesting to note that the web textile section 3 in the erected web structure 2 can be color-painted down the dotted line sections, as demonstrated in FIG. 3*a* to serve as elevation indicator for the web structure whilst serving in a tennis game. What is more, a ball, on approaching from arrow directions, when hit upon by a player, to give a strike against the webform 3 or 3*a*, will thenceforth rebound to the textile texture 3 on top of another webform 2 and revert to bound back again. This type of setting can be reinforced with a foot-rack as a grounding to enhance the security of the setting to hold in position throughout a game.

Figure 4:
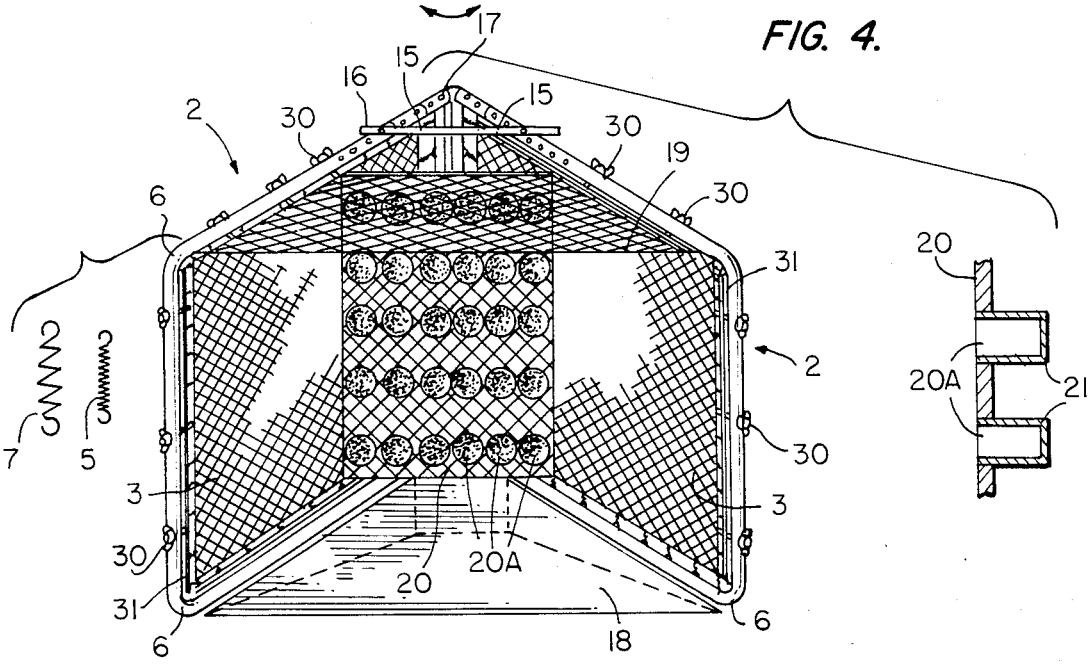
FIG. 4 is a three-dimensional view of two web pieces stretched to a setting in conjunction with a bee-hive web frame and a slant board.
Figure 5:
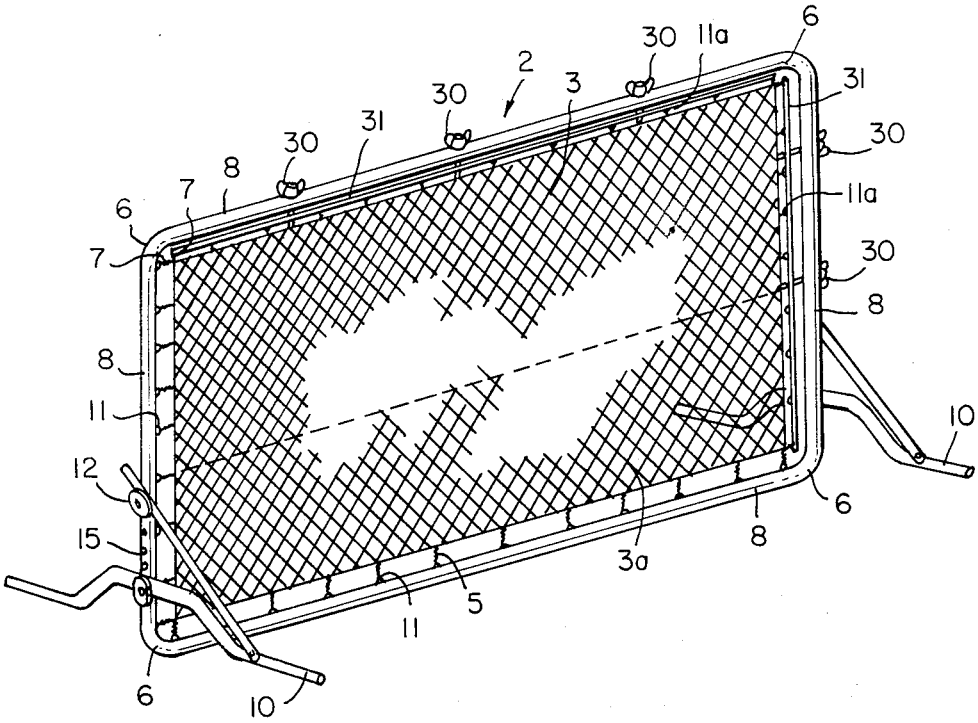
FIG. 5 is a view showing a single web piece set across on a foot-standing to a set-up position as covered by the present invention.

Referring now to FIG. 4 thereof is seen a protective screen 19 on the top of the webform shown, complete with a bee-hive webform 20 inside the joint surface of the two webworks 2, and with a slant but flat board 18 thereunder. This arrangement is meant to serve in a baseball game, the pitcher may throw the ball along arrow directions, the goal being composed of the bee-hive webform 20 that is provided with a number of composite grooves 20A on top with its rear section extended to make up for a number of bags 21 to facilitate choosing of any a given target by the pitcher himself. In addition, the reverberations due to the webwork 20 will suffice to achieve in the adjustment of the angle of openness of the two webforms 2 alongside the joint holes 15 in conjunction with an active strut 16. The rebounding reverberations are directly proportional to the angle of openness. The setting as illustrated in FIG. 4 may also serve for a golf training practice, and the golf ball will roll back along the slant board 18 for repeated service.

The movable webwork support for the training and sporting of ball games calls for little space requirement in a play and is available for convenient setting or dismantling as the sports game is to take place or else is coming to a close. What is more the tension or resilience of the webform can be adjusted to suitable conditions as the case may require, so it is to the inventor all fair to assert that this is truly a very convenient piece of invention ideally applicable to various ball games, be they a training course or recreational in nature.

The present invention is further considered a valuable piece of invention because it provides a miniature form of focus in a ball game that will apply to a number of known ball games with less space requirement and yet will yield the same spirit of enjoyment and practical utility as if run in life-size playing grounds.

All that has been attempted to describe the contents of the present invention as characterised thus far serves but as one execution of the embodiment of the present invention, they by no means serve to restrict and limit the scope of applications under the essential ideologies from which the present invention is derived, all revised setting, alterations and modification of applications of the present invention should be deemed as an infringement of the present invention if granted a patent permit in the country in which the present patent application is submitted.

I claim:

1. A movable webwork support for the training and sporting of ball games, comprising a framework surrounded by a tube formation for protection, the interior of said framework comprising a webwork edged with adjustment rods, said tube formation and said webworks being integrated by a number of ring-hooked spring retainers, means connecting said adjustment rods to the edges of said web work and adjusting screws for adjusting the tension of said webwork by displacing said adjustment rods, said adjusting screws extending between said tube formation and said adjustment rods.

2. The movable webwork support for the training and sporting of ball games according to claim 1, wherein said tube formation is provided with a two-way joint to facilitate link-up with another movable webwork support.

3. The movable webwork support for the training and sporting of ball games according to claim 1, wherein said tube formation is formed of metal tubes, plastic tubes, or rubber tubes.

4. The movable webwork support for the training and sporting of ball games according to claim 1, wherein said webwork comprises a fabric of nylon.

* * * * *